US007896705B2

(12) United States Patent
Kawasaki et al.

(10) Patent No.: US 7,896,705 B2
(45) Date of Patent: Mar. 1, 2011

(54) INTERFACE CONNECTOR AND PLUG

(75) Inventors: Takashi Kawasaki, Tokyo (JP); Takahiro Shimoyama, Tokyo (JP); Soichi Takagi, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 12/585,449

(22) Filed: Sep. 15, 2009

(65) Prior Publication Data

US 2010/0068943 A1 Mar. 18, 2010

(30) Foreign Application Priority Data

Sep. 16, 2008 (JP) ..... 2008-236835

(51) Int. Cl.
*H01R 24/00* (2006.01)

(52) U.S. Cl. ..... 439/660

(58) Field of Classification Search ..... 439/79, 439/80–83, 629, 941, 660
See application file for complete search history.

(56) References Cited

U.S. PATENT DOCUMENTS 5,342,208 A * 8/1994 Kobayashi et al. ..... 439/79
5,688,130 A * 11/1997 Huang ..... 439/79
5,725,385 A * 3/1998 Takano et al. ..... 439/64
5,813,871 A * 9/1998 Grabbe et al. ..... 439/108
7,108,552 B2 * 9/2006 Niitsu et al. ..... 439/607.35

FOREIGN PATENT DOCUMENTS

JP 11-354229 12/1999

* cited by examiner

*Primary Examiner*—Jean F Duverne
(74) *Attorney, Agent, or Firm*—The Nath Law Group; Jerald L. Meyer; Stanley N. Protigal

(57) ABSTRACT

An interface connector makes parts to be fitted by insertion hold the state where a receptacle and a plug are fitted, and removes the plug easily from the receptacle when load is applied to the plug from a direction other than the insertion direction. In the interface connector (10), the plug (100) has an inserting projection part (114) in which a plurality of plug terminals (120) are disposed in upper and lower faces (114*b* and 114*c*). The inserting projection part (114) is provided with a plurality of plug terminals (120) that project freely moving in and out of the upper and lower faces (114*b* and 114*c*) of the insertion projection part (114) by elastic deformation, and, when the inserting projection part (114) is inserted in the insertion slot (212) of the receptacle (200), a plurality of plug terminals (120) press against a plurality of receptacle terminals (220) provided in the receptacle (200) such that the insertion projection part (114) is held removably in receptacle (200) and is removed from the receptacle (200) when load is applied from a direction other than the insertion direction.

4 Claims, 7 Drawing Sheets

INTERFACE CONNECTOR AND PLUG

CROSS REFERENCE TO RELATED APPLICATIONS

The disclosure of Japanese Patent Application No. 2008-236835, filed on Sep. 16, 2008, including the specification, drawings and abstract, is incorporated herein by reference in its entirety.

TECHNICAL FIELD

The present invention relates to an interface connector used as an interface in electronic equipment. More particularly, the present invention relates to an interface connector that has a receptacle which is mounted on a print wiring board and a plug which is connected with the receptacle, and a plug.

BACKGROUND ART

Conventionally, electronic equipment such as mobile electronic equipment generally uses an interface connector that has a plug and a receptacle with an insertion slot which allows the plug to be inserted and removed, to connect with external equipment, such as a battery charger to supply power to electronic equipment. In the interface connector, a plug is inserted in the insertion slot of a receptacle to electrically connect contacts on the plug side with contacts on the receptacle side.

For example, Patent Literature 1 discloses a plug-type electrical connector (hereinafter "plug") having a plug part that rises from the bottom wall of a housing, and a receptacle-type electrical connector (hereinafter "receptacle") having an insertion slot in which the plug part is inserted. According to Patent Literature 1, in the plug part that rises from the bottom wall, a plurality of plug terminals are aligned in the longitudinal direction in both sidewall faces extending in the longitudinal direction orthogonal to the insertion direction to the receptacle. These plug terminals are provided to project from both sidewall faces, and elastically deform in directions to approach both side faces. Further, in the wall faces of the housing which partition the insertion slot in the receptacle, a plurality of receptacle terminals individually matching a plurality of plug terminals are aligned and disposed in the sidewall faces to face both side faces of the plug part inserted in the insertions slot.

When the plug part is inserted in the insertion slot in the receptacle, the plug terminals elastically deform to press against the receptacle terminals aligned in the insertion slot. In this way, the plug and receptacle form the interface connector by sufficiently inserting the plug part in the insertion slot, and welding the plug terminals to the receptacle terminals by pressure and fitting the plug terminals in the receptacle terminals.

Further, in the interface, the depth the plug part fits in the insertion slot is increased to secure the distance for the plug terminals to slide against the receptacle terminals when the plug part is inserted. This sliding makes the plug terminals and receptacle terminals clean portions where the plug and receptacle contact each other.

CITATION LIST

Patent Literature

PTL 1: Patent HEI11-354229

SUMMARY OF INVENTION

Technical Problem

By the way, as disclosed in Patent Literature 1, a fit of the plug part of the plug in the housing of the receptacle in which the plug part is inserted, holds the state where the plug terminals and receptacle terminals are connected, in a conventional interface connector.

In a state where the plug fits in the receptacle, when significant load is applied to the plug from a direction other than the direction of the insertion axis (the axis that is located in the center of the cross section of the portion to be fitted and that extends in the insertion direction), it is difficult to detach the plug from the receptacle. Therefore, when significant load is applied to the plug from a direction other than the insertion direction, load is applied to the plug part and a part of the receptacle that surrounds the plug part which form the fitting portion, and there is a possibility that the fitting portion is damaged.

It is therefore an object of the present invention to provide an interface connector and a plug that make parts to be fitted by insertion hold the state where the receptacle and the plug are fitted, and that removes the plug easily from the receptacle when load is applied to the plug from a direction other than the insertion direction.

Solution to Problem

To achieve the above object, the interface connector according to the first aspect of the present invention employs a configuration which includes: a plug with a plug inserting part in which a plurality of plug terminals are disposed to project from top and bottom faces of the plug inserting part; and a receptacle in which the plug inserting part is inserted and removed through a plug insertion slot and in which receptacle terminals are disposed in a pair of inner wall faces facing the top and bottom faces of the plug inserting part that is inserted through the plug insertion slot to electrically connect with the plug terminals, and in which: the plug terminals are provided to freely move in and out of the top and bottom faces of the plug inserting part by elastic deformation; and, when the plug inserting part is inserted in the receptacle, the plurality of plug terminals in the top and bottom faces press against the plurality of receptacle terminals in the pair of inner wall faces such that the plug inserting part is held or removed when load is applied from a direction other than an insertion direction.

To achieve the above object, the plug according to the second aspect of the present invention employs a configuration which includes: a plug inserting part which is inserted removably in a receptacle through a plug insertion slot; and plug terminals which, when the plug inserting part is inserted in the receptacle, electrically connect with a plurality of receptacle terminals provided in a pair of facing inner wall faces in the receptacle, and in which: the plurality of plug terminals are provided to project from top and bottom faces facing the pair of facing inner wall faces when the plug inserting part is inserted in the receptacle, and are provided to freely move in and out of the top and bottom faces by elastic deformation; and, when the plug inserting part is inserted in the receptacle, the plurality of plug terminals in the top and bottom faces press against the plurality of receptacle terminals in the pair of inner wall faces such that the plug inserting part is held or removed when load is applied from a direction other than an insertion direction.

ADVANTAGEOUS EFFECTS OF INVENTION

The present invention can realize an interface connector that makes parts to be fitted by insertion hold the state where the receptacle and the plug are fitted, and that removes the plug easily from the receptacle when load is applied to the plug from a direction other than the insertion direction.

DESCRIPTION OF EMBODIMENTS

Hereinafter, an embodiment of the present invention will be explained in detail with reference to the accompanying drawings.

Figure 1:
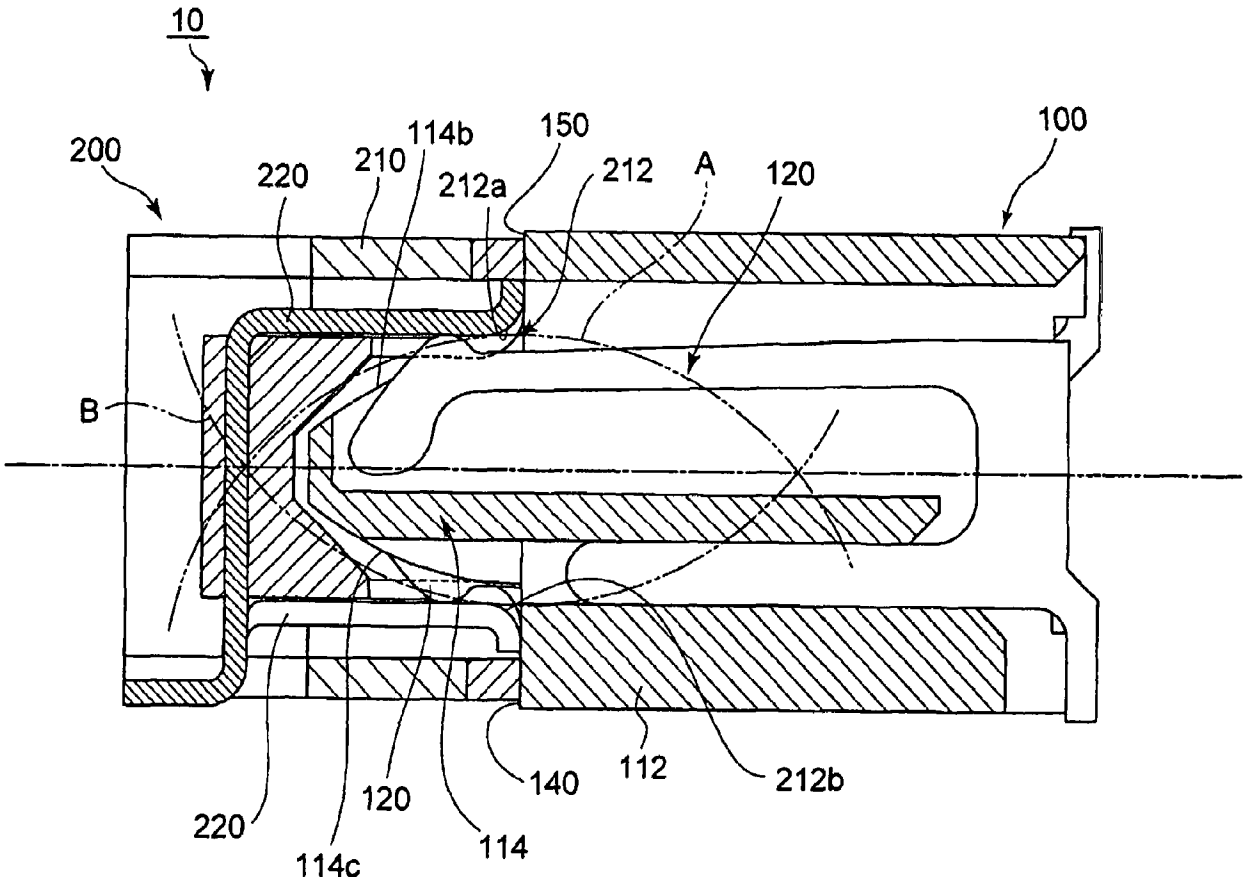
FIG. 1 shows an interface connector according to an embodiment of the present invention.

FIG. 1 shows interface connector 10 according to an embodiment of the present invention, and is a cross-sectional view showing the state where main parts of plug connector 100 and receptacle connector 200 constituting interface connector 10 are fitted. Meanwhile, hereinafter, with plug connector 100 of interface connector 10, the front side refers to the direction in which plug connector 100 is inserted in receptacle connector 200, and the back side refers to the direction in which plug connector 100 is removed from receptacle connector 200. The top, bottom, left and right in this plug connector 100 correspond to the top, bottom, left and right seen from the insertion direction side. Further, with receptacle connector 200, the front side refers to the insertion slot side in which plug connector 100, the connecting target, is inserted, and the back side refers to the insertion direction side. The top, bottom, left and right in this receptacle connector 200 correspond to the top, bottom, left and right seen from the insertion slot side.

Interface connector 10 shown in FIG. 1 has plug connector 100 (hereinafter "plug") that has inserting projection part 114 provided as a plug part to project from plug body 112, and receptacle connector 200 (hereinafter "receptacle") that has receptacle housing 210 in which inserting projection part 114 of plug 100 is inserted from insertion slot 212.

FIG. 1 shows the state where inserting projection part 114 of plug 100 is inserted from insertion slot 212 of receptacle 200 to fit in receptacle 200 and to electrically connect plug terminals 120 of plug 100 and receptacle terminals 220 of receptacle 200.

Figure 2:
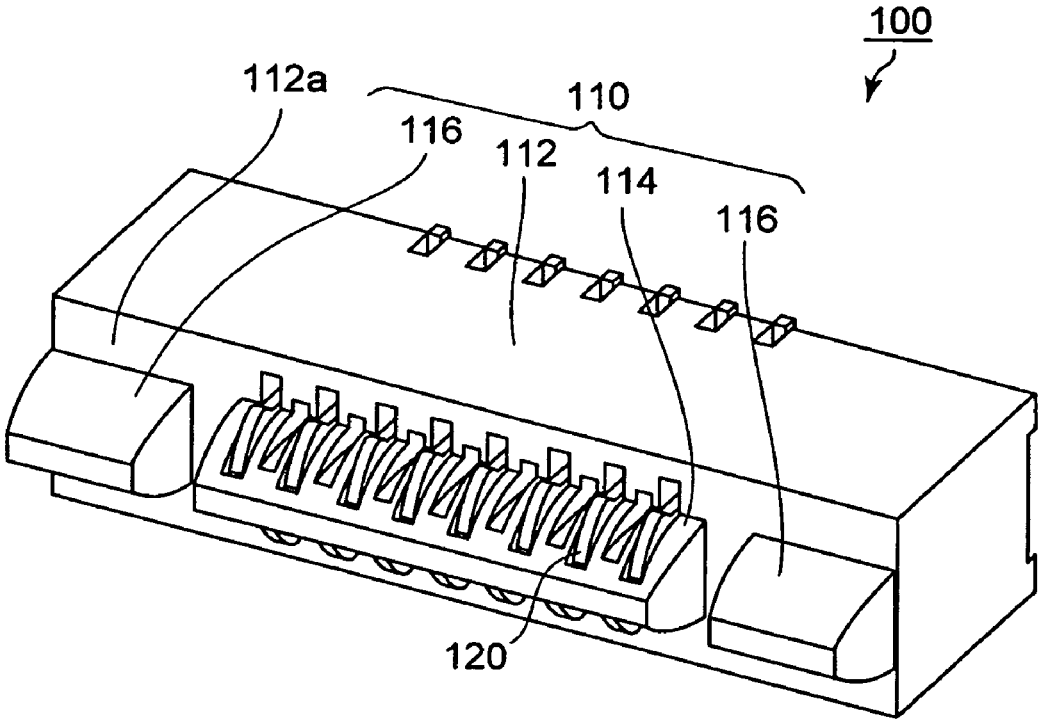
FIG. 2 is a perspective view of a plug connector of the interface connector shown in FIG. 1.
Figure 3:
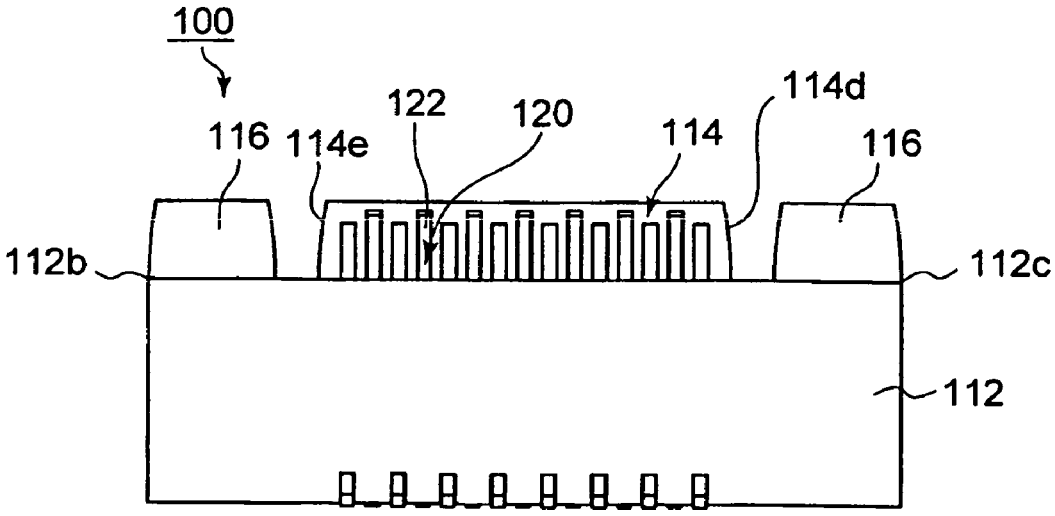
FIG. 3 is a bottom face view of the plug connector.
Figure 4:
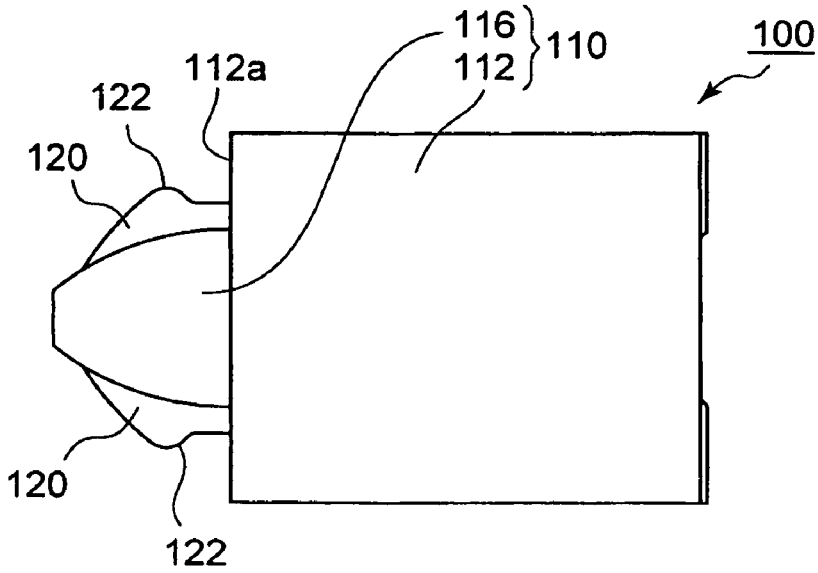
FIG. 4 is a right side view of the plug connector.

FIG. 2 is a perspective view of plug connector (plug) 100 in interface connector 10 shown in FIG. 1, FIG. 3 is a bottom face view of plug connector (plug) 100 and FIG. 4 is a right side view of plug connector (plug) 100.

As shown in FIG. 2 and FIG. 3, plug 100 has plug housing 110 that has: plug body 112 of a wide, rectangular parallelepiped shape; and inserting projection part 114 provided on the front side to project from front face 112*a* of plug body 112.

Plug housing 110 is made of an insulating material. Further, plug housing 110 has guiding projection parts 116 that are provided to project like inserting projection part 114 in positions to sandwich inserting projection part 114 in front face 112*a* of plug body 112, and that has the same shape of the side face as inserting projection part 114 (see FIG. 2 to FIG. 4).

Plug housing 110 has a plurality of plug terminals 120 to be connected with a plurality of receptacle terminals 220 provided in receptacle 200.

Figure 5:
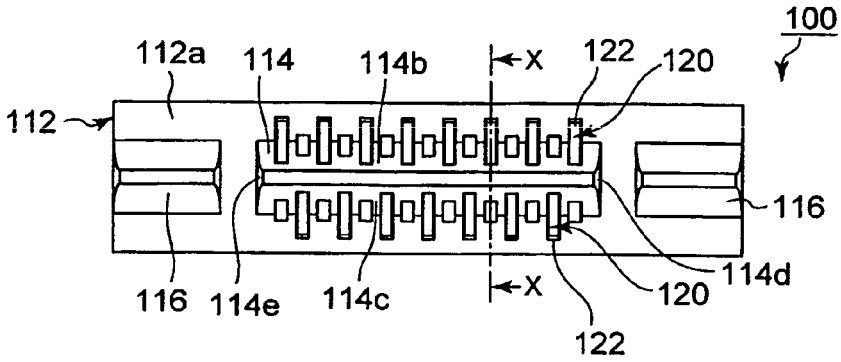
FIG. 5 is a front view of the plug connector.
Figure 6:
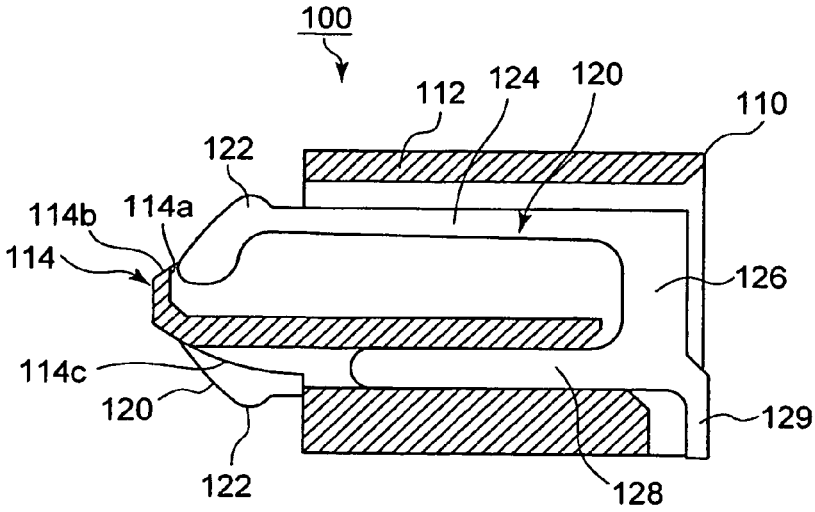
FIG. 6 is a cross-sectional view seen from the arrow in the X-X line in FIG. 5.

FIG. 5 is a front view of the plug connector, and FIG. 6 is a cross-sectional view seen from the arrow in the X-X line in FIG. 5.

As shown in FIG. 5, plug terminals 120 are disposed along the insertion direction, and contact point parts 122 of plug terminals 120 contacting receptacle terminals 220 of receptacle 200 protrude from both side faces of inserting projection part 114 in a zig-zag pattern.

Here, as shown in FIG. 6, plug terminals 120 are attached by pressing plug terminals 120 from the back face side of plug body 112 to fit in the hollow part that communicates the interior of inserting projection part 114 with the interior of plug body 112 inside plug housing 110 in the backward and forward directions.

Plug terminals 120 are flexible, and are formed by the electrically conductive member which is elastically deformable. As shown in FIG. 6, contact point part 122 is formed at the tip of swing arm 124 (hereinafter "arm") that extends in the insertion direction from the base part side of plug body 112. Arm 124 extends from the front end of rising tip 126 that rises from the lower face of plug body 112 on the base part side. Fixed strip 128 which extends toward the insertion direction side in parallel to arm 124, is provided in the base part of rising tip 126, and is fixed to plug body 112 by pressing and fitting.

Here, plug terminal 120 has a flat shape, and is formed by processing a metal plate and forming contact point part 122, arm 124, rising tip 126 and fixed strip 128. Further, lead part 129 that projects toward the back side of plug body 112, is provided in the portion where rising tip 126 and fixed strip 128 are jointed.

A plurality of plug terminals 120 are individually aligned in the left and right directions of the thickness direction of plug housing 110, that is, in the longitudinal direction (horizontal direction), and contact point parts 122 are horizontally aligned in a zig-zag pattern in inserting projection part 114.

That is, a plurality of plug terminals 120 are attached by placing the top and bottom of fitting arms 124 upside down alternately and pressing and fitting arms 124 in the upper and lower face parts of plug body 112 (see FIG. 5).

As shown in FIG. 6, arms 124 are arranged in plug body 112. Arm part 124 is cantilevered and supported by fixed strip 128 and rising tip 126 such that the contact point part 122 side becomes a free end. In this way, arm 124 extends from the back side of plug body 112 toward the front end side of inserting projection part 114, and is disposed movably in the direction in which arm 124 elastically deforms and moves away from fixed strip 128 and in the direction in which arm 124 approaches fixed strip 128.

Contact point part 122 at the tip of this arm 124 forms a bank, and the apex of this bank projects such that the apex of this bank freely moves in and out of each opening part 114*a* formed in upper and lower faces 114*b* and 114*c* of inserting projection part 114. That is, contact point part 122 of plug terminal 120 is attached to project in a state where contact point part 122 freely moves forward and backward to the outside (i.e. the upward and downward directions) from the inside of inserting projection part 114 through upper and lower faces (i.e. both side faces) 114*b* and 114*c* of inserting projection part 114.

Contact point part 122 contacts receptacle terminal 220 of receptacle 200 when plug 100 is inserted in receptacle 200.

Further, contact point part 122 can move to virtually the same face as the upper and lower faces (i.e. both side faces) of inserting projection part 114, and can move to the inner side of projecting upper face 114*b* or lower face 114*c* by the deformation of arm 124.

Upper and lower faces 114*b* and 114*c* of inserting projection part 114 provide curved faces that gradually approach toward the front end side. Here, assuming that a circle (shown by imaginary line A) places, in the center, lower rim part 140, which is the part where plug 100 abuts on receptacle 200, and passes upper rim part 212*a* inside insertion slot 212, when seen from the side view as shown in FIG. 1, upper face 114*b* is formed inside the circumference of this circle and along this circumference of this circle. Lower rim part 140 provides an outer rim that extends parallel to upper and lower faces 114*b* and 114*c* in the front face of receptacle housing 210, in which insertion slot 212 is formed in receptacle 200.

By contrast with this, assuming that a circle (shown by imaginary line B) places, in the center, upper rim part 150, which is part where plug 100 abuts on receptacle 200, and passes lower rim part 212*a* inside insertion slot 212, when seen from the side view as shown in FIG. 1, lower face 114*c* is formed inside the circumference of this circle and along this circumference of this circle. Upper rim part 150 provides an outer rim parallel to upper and lower faces 114*b* and 114*c* in the front face of receptacle housing 210, in which insertion slot 212 is formed in receptacle 200.

In this way, assuming that circles A and B place, in the centers, the outer rims (i.e. lower rim part 140 and upper rim part 150), which are provided apart from each other across the insertion axis, in the outer rim (i.e. lower rim part 140 and upper rim part 150) in the front face of receptacle housing 210 when inserting projection part 114 is inserted in plug insertion slot 212, and pass facing opening rim parts 212*a* and 212*b* of insertion slot 212, when seen from the side view, upper and lower faces (i.e. top and bottom faces) 114*b* and 114*c* of inserting projection part (plug inserting part) 114 provide the curved faces formed inside the circumferences of these circles A and B and along these circumferences.

Further, as shown in FIG. 3 and FIG. 5, both side faces 114*d* and 114*e* of inserting projection part 114 provide the curved faces that gradually approach toward the front end side.

As shown in FIG. 3, right side face 114*d* is formed along the circumference of the circle that places, in the center, left side rim 112*b* in front face 112*a* of plug body 112 and that passes the right side rim part inside insertion slot 212 (see FIG. 1). Further, left side face 114*e* is formed along the circumference of the circle that places, in the center, right side rim 112*c* in front face 112*a* of plug body 112 and that passes the left side rim part inside insertion slot 212 (see FIG. 1).

Furthermore, the upper and lower faces and the left and right side faces of guiding projection parts 116, provided apart from each other on the left and right sides of inserting projection part 114, can be explained in the same way as inserting projection part 114 using the guiding insertion slot instead of insertion slot 212, and provide the curved faces that curve in virtually the same way as the upper and lower faces and the left and right side faces of inserting projection part 114.

Figure 7:
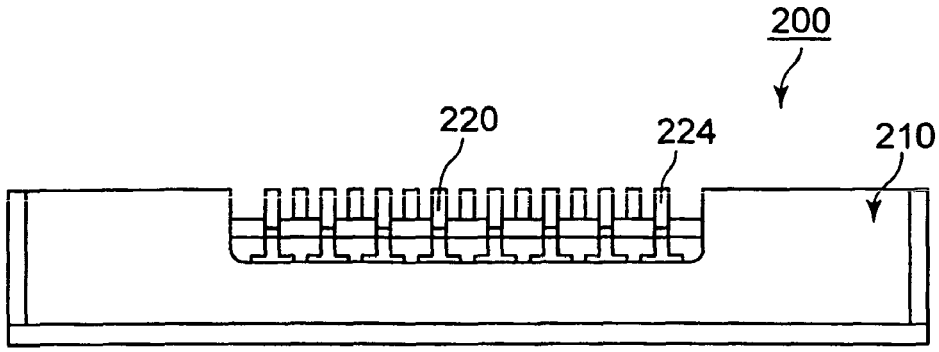
FIG. 7 is a top face view of a receptacle connector of the interface connector according to an embodiment of the present invention.
Figure 8:
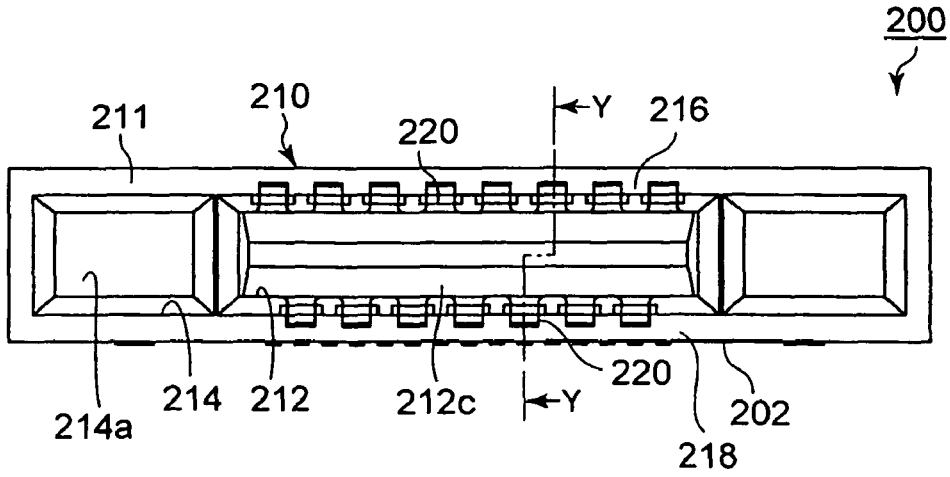
FIG. 8 is a front view of the receptacle connector.
Figure 9:
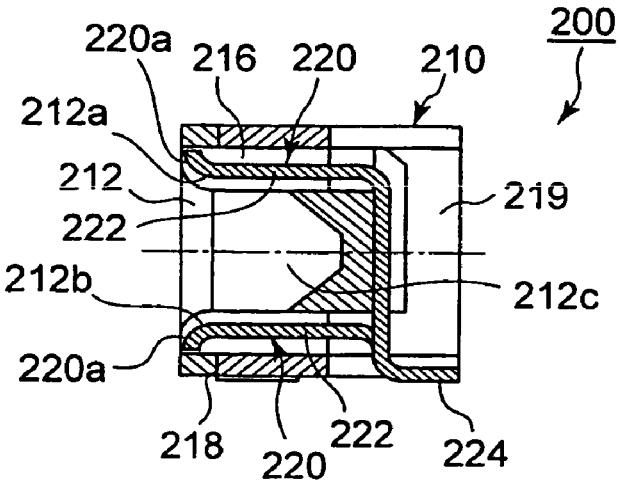
FIG. 9 is a cross-sectional view seen from the arrow in the Y-Y line in FIG. 8.

FIG. 7 is a top face view of the receptacle connector in the interface connector according to an embodiment of the present invention, FIG. 8 is a front view of the receptacle connector and FIG. 9 is a cross-sectional view seen from the arrow in the Y-Y line in FIG. 8.

Receptacle 200 shown in FIG. 7 has receptacle housing 210 of a wide, rectangular parallelepiped shape which is horizontally long, and receptacle terminals 220. Receptacle housing 210 is formed in front face 211 (see FIG. 8), and has: recipient part 212*c* and guiding recipient parts 214*a* that are open forward through insertion slot 212 that extends along the longitudinal direction (horizontal direction); and guiding insertion slots 214 that are provided across insertion slot 212.

In receptacle housing 210, recipient part 212*c* is formed to match inserting projection part 114, and accommodates inserting projection part 114 (see FIG. 1 to FIG. 3, FIG. 5 and FIG. 6) inside when plug 100 is connected. Further, guiding recipient parts 214*a* are formed to match guiding projection parts 116, and accommodate guiding projection parts 116 (see FIG. 1 to FIG. 3, FIG. 5 and FIG. 6) inside when plug 100 is connected.

Receptacle 200 shown in FIG. 7 to FIG. 9 has bottom face 202 (see FIG. 8) as a face to be mounted on the print substrate, and plug 100 is connected in a direction virtually parallel to the direction in which the printing substrate, on which bottom face 202 is mounted, extends.

Front face 211 of receptacle housing 210 has virtually the same outer shape as the shape of the front face of plug 100. When inserting projection part 114 and guiding projection parts 116 of plug 100 are inserted in insertion slot 212 and guiding insertion slots 214, front face 211 abuts on the front face portion of plug body 112 located around inserting projection part 114 and guiding projection parts 116.

Receptacle terminals 220 are provided in receptacle 200 to individually match plug terminals 120 provided in inserting projection part 114 of plug 100 to be inserted, and are horizontally disposed in a zig-zag pattern in upper and lower face parts 216 and 218 that partition insertion slot 214 seen from the front view (see FIG. 8 and FIG. 9).

Here, as shown in FIG. 9, receptacle terminal 220 locates contact point parts 222 of the tip side, in the inner wall faces of upper face part 216 and lower face part 218 of receptacle housing 210 to extend in the insertion direction, and projects rear end part 224 from back face part 219 to the outside.

Contact point parts 222 of receptacle terminal 220 have a thin, long, flat shape that extends from the insertion slot 212 side along the insertion direction, in the inner wall face of upper face part 216 and the inner wall face of lower face part 218 of receptacle housing 210. Tip parts 220*a*, the end parts of the insertion slot 212 side, in contact point parts 222 of receptacle terminal 220 are bent toward the sides of the faces in which contact point parts 222 are attached, and make the inner rim parts round like "r" (see FIG. 9). In contact point parts 222 of receptacle terminal 220 of receptacle 200 of the present embodiment, the boundary portions between tip parts 220*a* which are made round like "r" and flat portions which are exposed along upper face part 216 and lower face part 218 in recipient part 212*c*, correspond to upper rim part 212*a* and lower rim part 212*b* of insertion slot 212.

By this means, when inserting projection part 114 of plug 100 is inserted in recipient part 122*c* through insertion slot 212, plug terminals 120 slide against tip parts 220*a*, which are the "r" portions of contact point parts 222 in individually matching receptacle terminals 220, and are guided to the depths side and held in a state where plug terminals 120 press against the flat portions of contact point parts 222 by elastic deformation.

Although, with the present embodiment, lead parts 224 of receptacle terminals 220 disposed in upper and lower faces 216 and 218 of receptacle housing 210 are configured to extend in back face part 219 of receptacle housing 210 from the lower end side to the outside along the bottom face, the locations where lead parts 224 are arranged can be appropriately changed.

Figure 10:
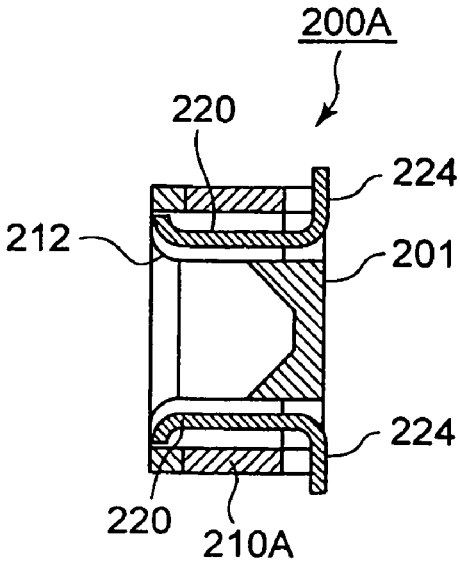
FIG. 10 is a cross-sectional view showing a modified example of main parts of the receptacle connector of the interface connector according to an embodiment of the present invention.

In case where, for example, the insertion direction of plug 100 is the direction orthogonal to the print substrate, the configuration of receptacle 200A shown in FIG. 10 may be employed. Meanwhile, compared to receptacle 200, receptacle 200A shown in FIG. 10 employs the same configuration except for the direction from which lead parts 224 of receptacle terminals 220 are guided to the outside.

In this receptacle 200A, lead parts 224 of receptacle terminals 220 are guided to the outside from the upper and lower side parts of back face 201 of receptacle housing 210A that forms insertion slot 212 in the front face, in directions in which lead parts 224 vertically move away from each other. That is, in receptacle 200A, receptacle terminal 220 provided in upper face part 216 guides lead part 224 upward in parallel to back face 201, to the outside. Further, receptacle terminal 220 provided in lower face part 218 guides lead part 224 downward in parallel to back face 201, to the outside. By this means, in receptacle 200A, back face 201 is mounted on the print substrate, thereby connecting and mounting lead parts 224 on the wiring pattern on the print substrate.

Next, the operation of attaching and removing plug 100 to and from receptacle 200 will be explained.

Inserting projection part 114 and guiding projection part 116 of plug 100 are inserted inside receptacle 200 from insertion slot 212 and guiding insertion slot 214 of receptacle 200.

When inserting projection part 114 is inserted in recipient part 212*c*, a plurality of plug terminals 120 disposed in inserting projection part 114 elastically deform and slide against a plurality of receptacle terminals 220 arranged in the upper and lower face parts of the receptacle housing to be inserted inside recipient part 212*c*.

Plug terminals 120 are arranged to project in the upward and downward directions from the upper and lower faces of inserting projection part 114, and are placed inside the recipient part in a state where receptacle terminals 220 in the upper and lower face parts that partition the recipient part at the top and bottom, are pressed in the upward and downward directions.

By this means, inserting projection part 114 is held in a state where inserting projection part 114 fits in the receptacle housing by the restoring force of elastically deformed plug terminals 120 and the plug itself is held by the receptacle in a state where the front face of plug body 112 abuts on the front face of the housing of the receptacle.

Consequently, in interface connector 10, plug 100 and receptacle 200 are held in an electrically connected state.

Further, guiding projection parts 116 provided on both sides of inserting projection part 114 in the front face of plug body 112 guide inserting projection part 114 such that inserting projection part 114 is adequately inserted from the insertion slot to the recipient part.

A case will be explained where external force from a direction other than the insertion direction is applied to plug 100 in interface connector 10 where plug 100 fits in receptacle 200 in this way.

A case will be explained as an example where receptacle 200 is equipped in a music/video viewing mobile terminal mounting a secondary battery, and plug 100 provided at the front end of the cable derived from a battery charger is fitted in this receptacle to electrically connect the battery charger and secondary battery.

In such a connected state, that is, in a state where plug 100 and receptacle 200 are fitted, when, for example, the cable connected with plug 100 is pulled, external force is applied to the portion of plug 100 fitting in receptacle 200 from a direction different from the insertion direction.

With a conventional configuration where the depth a plug is inserted in a receptacle is increased to make it difficult to remove the plug by external force applied to the fitted portion from a direction different from the insertion direction, when plug 100 connected through interface connector 10 is pulled, electronic equipment mounted on a desk and so on is also pulled through the receptacle and there is a possibility that electronic equipment falls from the desk and so on.

With the present embodiment, when external force is applied to plug 100 that fits in receptacle 200, from a direction different from the insertion direction, plug 100 moves in the direction in which plug 100 rotates about the front end side from the position on the insertion axis. To be more specific, plug 100 rotates about a part in front face 112*a* of plug body 112 surrounding inserting projection part 114 that abuts on front face 211 of receptacle 200, in the direction to cross the insertion axis.

Then, inserting projection part 114 also rotates about the base part side inside recipient part 212*c*, and is released from the state where inserting projection part 114 fits in receptacle housing 210 inside recipient part 212*c* of receptacle housing 210, and is removed from recipient part 212*c*.

Figure 11:
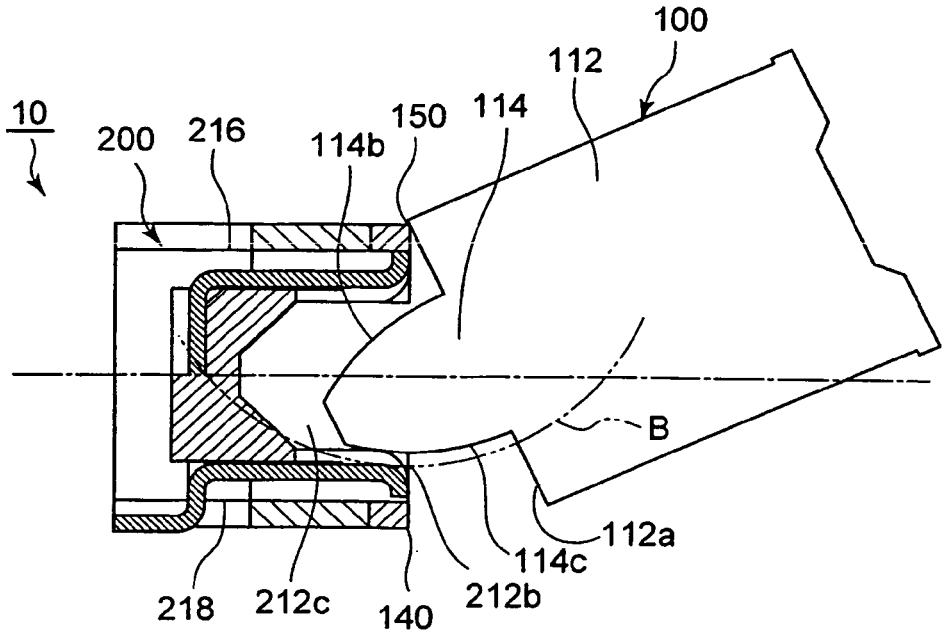
FIG. 11 is a cross-sectional view of main parts of the interface connector to illustrate the operation of the plug to which external force to pull upward the plug fitted in the receptacle is applied.
Figure 12:
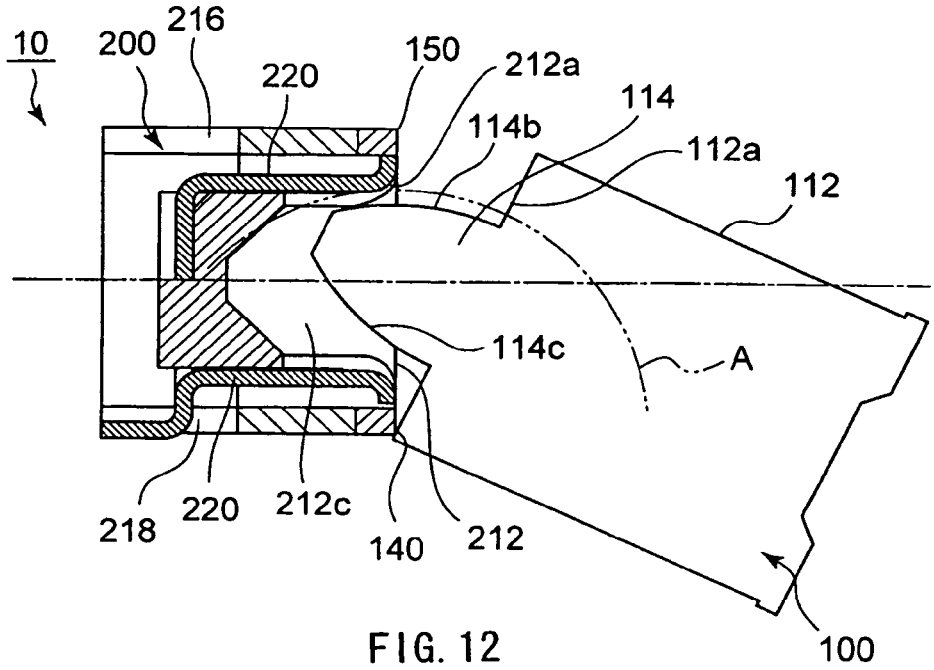
FIG. 12 is a cross-sectional view of main parts of the interface connector to illustrate the operation of the plug to which external force to pull downward the plug fitted in the receptacle is applied.

FIG. 11 and FIG. 12 are cross-sectional views of main parts of the interface connector illustrating how the plug moves when external force to pull the plug upward is applied to the plug that fits in the receptacle, and how the plug moves when external force to pull the plug downward is applied to the plug that fits in the receptacle.

As shown in FIG. 11, plug body 112 of plug 100 that fits in receptacle 200 tries to move above the insertion axis pivotally on the front end side. Accompanying this, inserting projection part 114 rotates: about upper rim part 150 where plug 100 abuts on receptacle 200; inside this circumference of circle B that passes lower rim part 212*b* inside insertion slot 212; and along the circumference of circle B. Then, inside recipient part 212*c*, the plug terminals (not shown) projecting from lower face 114*c* of inserting projection part 114 are pressed against receptacle terminals 220 disposed in lower face part 218 and elastically deformed, thereby changing their locations to the locations at virtually the same plane height as lower face 114*c* when seen from the side view. Then, lower face 114*c* of inserting projection part 114 moves along lower rim part 212*b*, and inserting projection part 114 itself is removed from recipient part 212*c*.

Further, as shown in FIG. 12, when plug body 112 of plug 100 that fits in receptacle 200 tries to move below the insertion axis pivotally on the front end side, inserting projection part 114 rotates: about lower rim part 140 where plug 100 abuts on receptacle 200; inside this circumference of circle A that passes upper rim part 212*a* inside insertion slot 212; and along the circumference of circle A. Then, inside recipient part 212*c*, the plug terminals (not shown) projecting from upper face 114*b* of inserting projection part 114 are pressed against receptacle terminals 220 disposed in upper face part 216 and elastically deformed, thereby changing their locations to the locations at virtually the same plane height as upper face 114*b* when seen from the side view. Then, upper face 114*b* of inserting projection part 114 moves along lower rim part 212*b*, and inserting projection part 114 itself is removed from recipient part 212*c*.

As described above, interface connector 10 of the present embodiment has plug 100 that has inserting projection part 114 in which a plurality of plug terminals 120 are disposed in upper and lower faces 114*b* and 114*c*. Further, interface connector 10 has receptacle 200 in which inserting projection part 114 is inserted and removed through plug insertion slot 212. In receptacle 200, when inserting projection part 114 is inserted through insertion slot 212, upper and lower face parts 216 and 218 form a pair of inner wall faces facing upper and lower faces 114*b* and 114*c* of inserting projection part 114, inside insertion slot 212. Receptacle terminals 220 are disposed in upper and lower face parts 216 and 218 to electrically connect with plug terminals 120 of inserting projection part 114. Meanwhile, a plurality of plug terminals 120 are provided in insertion projection part 114 to project freely moving in and out of upper and lower faces 114*b* and 114*c* of inserting projection part 114 by elastic deformation. When inserting projection part 114 is inserted in insertion slot 212, a plurality of plug terminals 120 in upper and lower faces 114*b* and 114*c* press against a plurality of matching receptacle terminals 220 in a pair of inner wall faces, so that inserting projection part 114 is held removably in receptacle 200. By contrast with this, when load is applied from a direction other than the insertion direction, inserting projection part 114 that is inserted in insertion slot 212 is removed from receptacle 200.

That is, in interface connector 10, when load is applied to plug 100 that fits in receptacle 200, from a direction other than the insertion direction or when load is applied to plug 100 that fits in receptacle 200, from a direction other than the insertion direction to remove plug 100, plug terminals 120 do not interfere with upper rim part 212*a* which is the opening rim of recipient part 212*c* and insertion slot 212, and releases the state where receptacle terminals 220 are pressed. Accompanying this, inserting projection part 114 is removed from the insertion slot, the state where plug 100 and receptacle 200 are fitted is released, and plug 100 is removed from receptacle 200 easily.

Further, although interface connector 10 of the present embodiment employs a configuration where plug 100 has guiding projection part 116 in the front face of plug body 112 and on both sides of inserting projection part 114, and where receptacle 200 has a guiding insertion slot in which guiding projection parts 116 are inserted when plug 100 fits in receptacle 200, a configuration without these guiding projection parts 116 and guiding insertion slot may be possible.

Further, when plug 100 is inserted in receptacle 200, interface connector 10 secures the force of holding the state where plug 100 and receptacle 200 are fitted after plug terminals 120 slide against receptacle terminals 220.

Furthermore, when plug 100 is removed from receptacle 200, plug terminals 120 slide against receptacle terminals 220.

In this way, upon insertion and removal of plug 100 with respect to receptacle 200, terminals 120 and 220 of plug 100 and receptacle 200 slide against each other, thereby removing dust between these terminals (self-cleaning) and secure the stability of the state where terminals 120 and 220 are contacted.

An embodiment of the present invention have been explained above. Further, the above present invention can be variously modified without departing from the spirit of the present invention, and it naturally follows that the present invention covers such modifications.

INDUSTRIAL APPLICABILITY

The interface connector and plug according to the present invention provide advantages of making parts to be fitted by insertion hold a fitting state and removing a plug from a receptacle easily when load is applied from a direction other than the insertion axis direction, and therefore is useful as an interface connector.

REFERENCE SIGNS LIST

10 INTERFACE CONNECTOR
100 PLUG
110 PLUG HOUSING
112 PLUG BODY
114 INSERTING PROJECTION PART
114*b* UPPER FACE
114*c* LOWER FACE
116 GUIDING PROJECTION PART
120 PLUG TERMINAL
122 CONTACT POINT PART
124 ARM
140 LOWER RIM PART
150 UPPER RIM PART
200, 200A RECEPTACLE
201 BACK FACE
210, 210A RECEPTACLE HOUSING
211 FRONT FACE
212 INSERTION SLOT
212*a* UPPER RIM PART
212*b* LOWER RIM PART
214 GUIDING INSERTION SLOT
216 UPPER FACE PART
218 LOWER FACE PART
220 RECEPTACLE TERMINAL

The invention claimed is:

1. An interface connector comprising:

a plug with a plug inserting part in which a plurality of plug terminals are disposed to project from top and bottom faces of the plug inserting part; and a receptacle in which the plug inserting part is inserted and removed through a plug insertion slot, the receptacle having receptacle terminals that are disposed in a pair of inner wall faces of the receptacle, which face the top and bottom faces of the plug inserting part that is inserted through the plug insertion slot, to electrically connect with the plug terminals, wherein:

the plug terminals are provided to freely move in and out of the top and bottom faces of the plug inserting part by elastic deformation; and the top and bottom faces of the plug inserting part having curved faces, and, when the plug inserting part is inserted in the receptacle, the plurality of plug terminals provided in the curved top and bottom faces press against the plurality of receptacle terminals in the pair of inner wall faces such that the plug inserting part is held or removed when load is applied from a direction other than an insertion direction.

2. An interface connector comprising:

a plug with a plug inserting part in which a plurality of plug terminals are disposed to project from top and bottom faces of the plug inserting part; and a receptacle in which the plug inserting part is inserted and removed through a plug insertion slot, the receptacle having receptacle terminals that are disposed in a pair of inner wall faces of the receptacle, which face the top and bottom faces of the plug inserting part that is inserted through the plug insertion slot, to electrically connect with the plug terminals, wherein:

the plug terminals are provided to freely move in and out of the top and bottom faces of the plug inserting part by elastic deformation, when the plug inserting part is inserted in the receptacle, the plurality of plug terminals in the top and bottom faces press against the plurality of receptacle terminals in the pair of inner wall faces such that the plug inserting part is held or removed when load is applied from a direction other than an insertion direction; and in a state where the plug inserting part is inserted in the receptacle, when seen from a side view, the top and bottom faces of the plug inserting part comprise curved faces formed along and inside circumferences of corresponding circles, the circumferences placing, in centers of the corresponding circles, outer rims which are provided apart from each other across an insertion axis, and passing over an opening rim of the plug insertion slot facing the top and bottom faces.

3. A plug comprising:

a plug inserting part configured to be inserted removably in a receptacle through a plug insertion slot; and plug terminals which, when the plug inserting part is inserted in the receptacle, electrically connect with a plurality of receptacle terminals provided in a pair of facing inner wall faces in the receptacle, wherein:

the plurality of plug terminals are provided to project from top and bottom faces of the plug inserting part so as to face the pair of facing inner wall faces of the receptacle when the plug inserting part is inserted in the receptacle, and are provided to freely move in and out of the top and bottom faces by elastic deformation; and the top and bottom faces of the plug inserting part having curved faces, and, when the plug inserting part is inserted in the receptacle, the plurality of plug terminals provided in the curved top and bottom faces press against the plurality of receptacle terminals in the pair of inner wall faces such that the plug inserting part is held in or removed from the receptacle when load is applied from a direction other than an insertion direction.

4. An interface connector comprising:

a plug with a plug inserting part in which a plurality of plug terminals are disposed to project from top and bottom faces of the plug inserting part; and a receptacle in which the plug inserting part is inserted and removed through a plug insertion slot and in which receptacle terminals are disposed in a pair of inner wall faces facing the top and bottom faces of the plug inserting part that is inserted through the plug insertion slot to electrically connect with the plug terminals, wherein:

the plug terminals are provided to freely move in and out of the top and bottom faces of the plug inserting part by elastic deformation; and when the plug inserting part is inserted in the receptacle, the plurality of plug terminals in the top and bottom faces press against the plurality of receptacle terminals in the pair of inner wall faces such that the plug inserting part is held or removed when load is applied from a direction other than an insertion direction, wherein:

the plug insertion slot is formed in a front face of a receptacle body of the receptacle;

the front face comprises a pair of outer rims which are parallel to the top and bottom faces of the plug inserting part that is inserted in the receptacle and which extend orthogonal to the insertion direction;

the plug comprises a plug body in which the plug inserting part is provided to project;

the plug body abuts on the front face of the receptacle body when the plug inserting part is inserted from the plug insertion slot; and in a state where the plug insertion part is inserted in the receptacle, when seen from a side view, the top and bottom faces of the plug inserting part comprise curved faces formed along circumferences and inside the circumferences, the circumferences placing, in centers, outer rims which are provided apart from each other across an insertion axis in the pair of outer rims and passing over an opening rim of the plug insertion slot facing the top and bottom faces.

* * * * *